US005145475A

United States Patent [19]

Cares

[11] Patent Number: 5,145,475

[45] Date of Patent: Sep. 8, 1992

[54] EXERCISER

[75] Inventor: Paul Cares, Holland, Mich.

[73] Assignee: P and L Partnership, Grand Rapids, Mich.

[21] Appl. No.: 691,460

[22] Filed: Apr. 25, 1991

[51] Int. Cl.[5] ..... A63B 22/04

[52] U.S. Cl. ..... 482/52; 482/62

[58] Field of Search ..... 482/51, 52, 53, 62

[56] References Cited

U.S. PATENT DOCUMENTS

| | | | |
|---|---|---|---|
| 2,042,764 | 6/1936 | Birch . | |
| 3,213,852 | 10/1965 | Zent | 128/25 R |
| 3,497,215 | 2/1970 | Harrison et al. . | |
| 3,592,466 | 7/1971 | Parsons . | |
| 4,555,108 | 11/1985 | Monteiro . | |
| 4,687,195 | 8/1987 | Potts . | |
| 4,726,581 | 2/1988 | Chang . | |
| 4,822,029 | 4/1989 | Sarno et al. . | |
| 4,842,269 | 6/1989 | Huang | 482/62 |
| 4,848,737 | 7/1989 | Ehrenfield . | |
| 4,927,136 | 5/1990 | Leask . | |
| 5,000,441 | 3/1991 | Wang | 482/51 |

FOREIGN PATENT DOCUMENTS 3502132 7/1986 Fed. Rep. of Germany .

OTHER PUBLICATIONS

"Dual Action Climber", p. 16, published by Sharper Image, P.O. Box 7031, San Francisco, Calif., 94120-7031, telephone 1-800-344-4444, date of publication unknown.

"Treadwall", p. 17, published by Sharper Image, P.O. Box 7031, San Francisco, Calif., 94120-7031, telephone 1-800-344-4444, date of publication unknown.

"C614 Vertical Ascent Climber", product brochure published by Tunturi, Inc., P.O. Box 2470, Redmond, Wash. 98073, telephone 206-881-8156, date of publication unknown.

"Versa Climber", first version, product brochure published by Heart Rate, Inc., 3188-E Airway Avenue, Costa Mesa, Calif. 92626, telephone 714-850-9716, date of publication unknown.

"Versa Climber", second version, product brochure published by Heart Rate, Inc., 3188-E Airway Avenue, Costa Mesa, Calif. 92626, telephone 714-850-9716, date of publication unknown.

*Primary Examiner*—Stephen R. Crow

*Attorney, Agent, or Firm*—Price, Heneveld, Cooper DeWitt & Litton

[57] ABSTRACT

An exerciser provides low impact exercise for the upper and lower body of an operator. The apparatus includes an upper portion having moving rungs simulating a hand-over-hand motion to exercise one's upper body and a lower portion having moving platforms simulating a stair-like climbing motion to exercise one's lower body. The upper and lower portions are oriented at different angles to maximize user comfort, the angle of the lower portion in particular providing clearance for one's knees during use. The exerciser also includes a variable speed control to adjustable vary the speed of the moving rungs and platforms, thereby adapting to the needs of various users.

32 Claims, 4 Drawing Sheets

EXERCISER

BACKGROUND OF THE INVENTION

The present invention relates to an exerciser, and in particular to a low impact, full body exerciser.

Various exercisers have been designed in response to the modern emphasize on fitness. However, many of the devices do not provide for balanced exercising of one's whole body. Further, even with devices designed to pace the user, it is possible to 'fool' the device or become lazy such that the workout is less beneficial than desired. Many devices which do offer a full body aerobic workout are inflexible and difficult to use, particularly for older or heavier individuals.

In sports there is also a need for improved ways to condition athletes. For example, it is common for athletes to repeatedly ascend and descend stadium bleachers as a way of conditioning. However, such practices can be dangerous since the athletes are subject to falling and hurting themselves on the hard and irregular surfaces of the bleachers. Further, when the weather does not cooperate, indoor bleachers are not always available.

Thus an exerciser which provides a balanced and complete aerobic workout of one's entire body, but which is flexible and easy to use is desired.

SUMMARY OF THE INVENTION

The present invention solves the aforementioned problems by providing a first and second mechanism for exercising the upper and lower body of an operator, respectively. The first mechanism includes handle means which move and simulate a hand-over-hand motion, while the second mechanism includes platform means which move and simulate a stair-like climbing motion.

In one form, the first and second mechanisms are angled and positioned to optimize an operator's comfort during use. This includes providing clearance for the knees of the operator during use. Further, the speed of the first and second mechanisms can be varied to control the amount of exercise that will be obtained from using the exerciser.

In a narrower form, the exerciser includes a control that is programmable so that multiple speeds and time durations of each speed can be preset for a pre-programmed exercise routine. The control may include a photocell for increased safety. In yet another narrower form, the lower mechanism includes a sheet of flexible material fastened to the rear of and between the multiple platforms for safety and aesthetics.

In still another form, the upper and lower mechanisms are pivotally interconnected for ease of setup between a folded position for shipping and an upright position for use.

The present invention includes several advantages over known art. The invention provides a balanced, low-impact, full body aerobic exercise for both the upper and lower body of an operator. During this exercise, the operator's body is in total suspension, the body being actively supported only by the operators moving arms and legs thereby reducing the ability of an operator to "cheat" or become lazy. The upper and lower mechanisms are specially adapted for the operator's upper and lower body, respectively, thereby increasing functional use and safety. The ease and flexibility of use make the exerciser useable by persons who are somewhat less agile such as older or heavier persons, as well as athletes who desire a challenging and extensive workout. These and other features, objects and advantages of the present invention will become apparent upon reading the following description thereof together with reference to the accompanying drawings in which:

DETAILED DESCRIPTION OF THE PREFERRED EMBODIMENT

Figure 1:
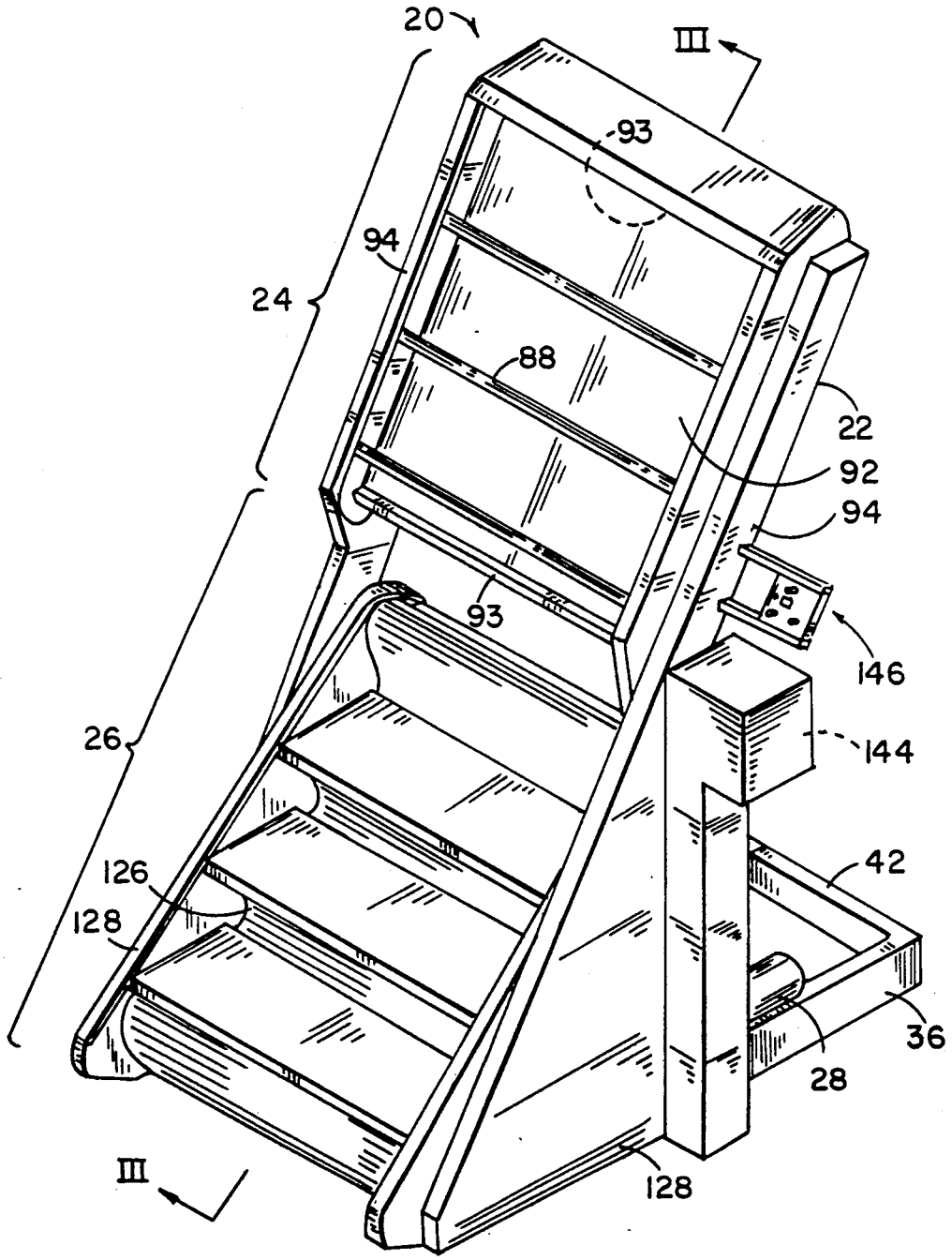
FIG. 1 is a perspective view of an apparatus embodying the present invention.
Figure 2:
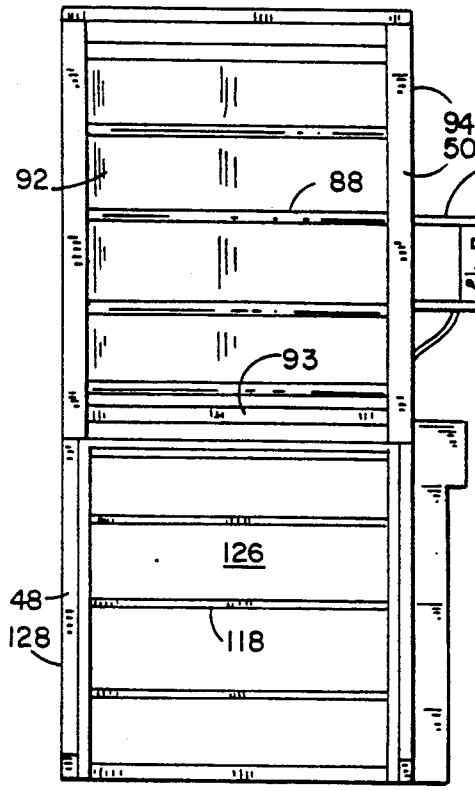
FIG. 2 is a front view of the apparatus in FIG. 1.
Figure 5:
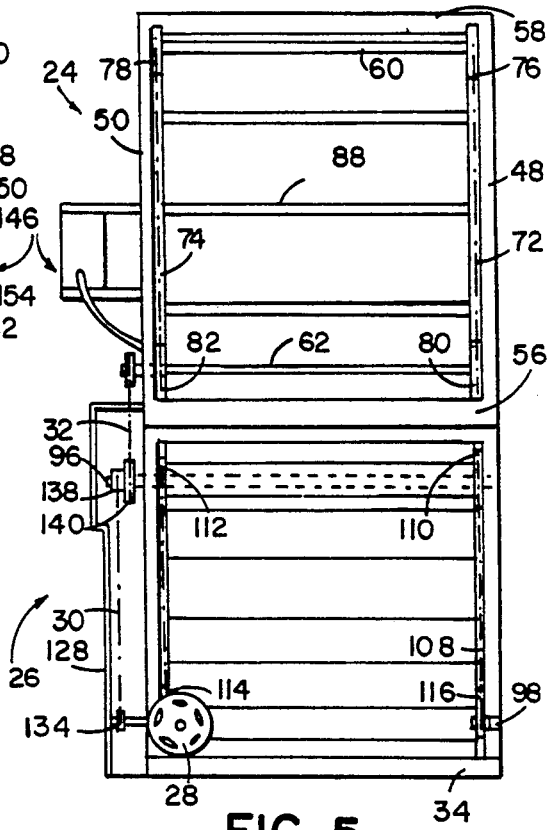
FIG. 5 is a rear elevational view of the apparatus in FIG. 1 with a portion of the guards removed to show the endless chains and powering mechanism.
Figure 3:
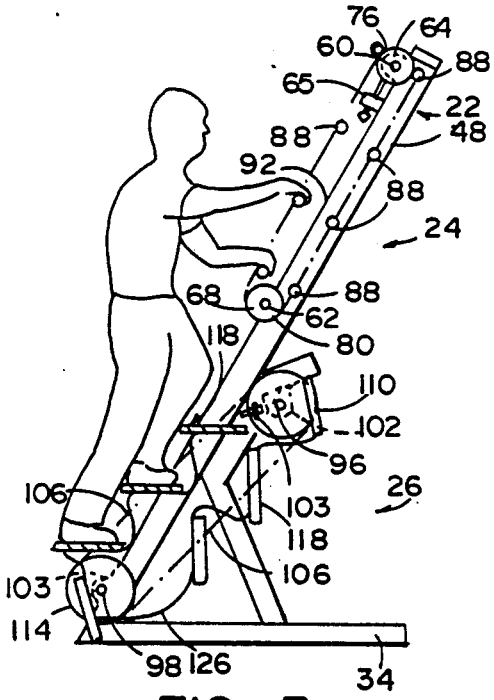
FIG. 3 is a sectional taken along the lines III—III in FIG. 1 and showing the position of an operator.
Figure 4:
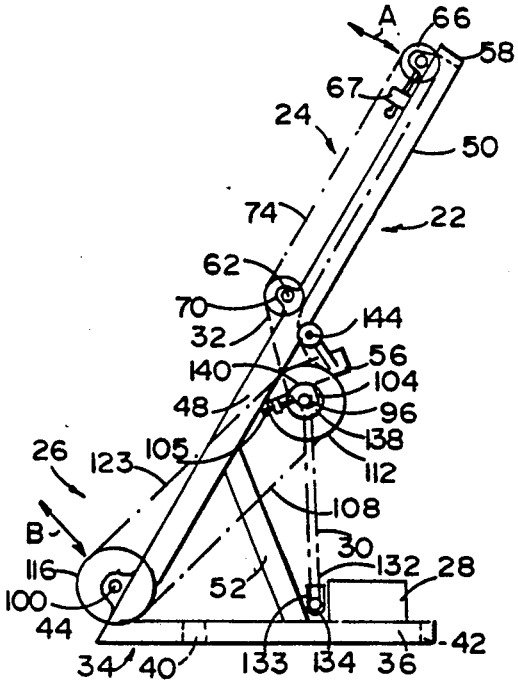
FIG. 4 is a side elevation of the apparatus in FIG. 1 with the side guard removed to schematically show the endless chains and the powering mechanism.

Referring now to the drawings and the embodiments illustrated therein, an exerciser or apparatus embodying the present invention is shown in the attached figures and is generally referred to as numeral 20 (FIG. 1). Exerciser 20 includes an upright frame 22 upon which upper and lower mechanisms 24 and 26, respectively, are supported. A motor 28 operates primary endless drive chain 30 and secondary endless drive chain 32 to drive mechanisms 24 and 26 at a coordinated and variable speed (FIG. 4).

Upright frame 22 (FIGS. 1 and 4) is a rigid framework constructed of tubular beams for strength. Frame 22 includes a planar base 34 made of two side members 36 and front and rear cross members 40, 42 which are interconnected to form a rigid support structure. Side members 36 have protruding portions 44 that extend forward of front cross member 40. Primary side upright members 48, 50 attach to the forward end of protruding portions 44 and extend diagonally upwardly and rearwardly a vertical distance above the height of a typical person and at a angle which promotes the comfortable operation of exerciser 20, as discussed below. A pair of support beams 52 extend between side members 36 of base 34 and upright members 48, 50 to rigidly fix the angular position of upright members 48, 50. A rearwardly offset middle cross member 56 and a top cross member 58 rigidly interconnect upright members 48, 50 to complete the rigid frame.

Upper mechanism 24 includes upper and lower axles 60 and 62 which extend horizontally between upright members 48, 50 and attach to upright members 48, 50 for rotational movement within bearings 64, 66, 68 and 70. Bearings 64, 66, 68 and 70 may attach to the front of upright members 48, 50 to facilitate assembly and to establish a proper angle for mechanism 24, but alternative designs are possible. Upper bearings 64 and 66 are slideably adjustable by adjustment mechanisms 65 and 67 on upright members 48, 50 so that endless chains 72, 74 which extend between axles 60, 62 on sprockets 76, 78, 80 and 82 can be properly tightened. Lower axle 62 further includes a secondary drive chain 32 (FIG. 4) for powering upper mechanism 24.

A safety shield 92 is positioned between upright members 48, 50 and between axles 60 and 62 (FIG. 1). It is contemplated that shield 92 will include upper and lower portions 93 that cover axles 60, 62, although several alternative arrangements are possible. For example, lower axle 62 could be constructed with a split shaft so that the central area is entirely open (i.e. similar to axles 98 and 100 of lower mechanism 26). Side shields 94 (FIG. 1) are positioned around the front of endless chains 72, 74 as they extend along the useful segment of the path of rungs 88 to protect against accidental rubbing or contacting of chains 72, 74. These shields increase both the safety and aesthetics of upper mechanism 24.

Figure 7:
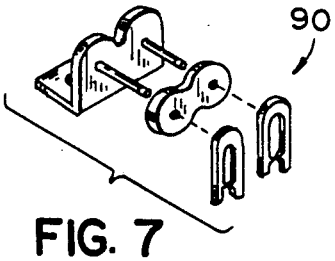
FIG. 7 is an enlarged perspective view of a bracket which attaches to the endless chain.

Hand supports or rungs 88 attach between endless chains 72, 74 by use of brackets 90 (FIG. 7). Rungs 88 have a diameter which is conducive for grasping by the hands of an operator. Sprockets 76, 78, 80 and 82 are properly sized so that endless chains 72, 74 and specifically rungs 88 have a clearance for an operator's fingers between them and shield 92 as rungs 88 traverse downwardly in front of shield 92. Rungs 88 establish a path as they travel in an oblong pattern diagonally downwardly from axle 60 to axle 62 in front of shield 92 during a useful segment, around lower axle 62, upwardly behind shield 92, and around upper axle 60. In the preferred embodiment, six to eight round rungs are used, although it is contemplated that various numbers and shapes of rungs can be used.

Lower mechanism 26 is adapted for use with an operator's lower body. Lower mechanism 26 includes an upper axle 96 and right and left lower axles 98 and 100. Upper axle 96 extends horizontally between and is rotationally mounted within bearings 102, 104, which are adjustably mounted on the backside of upright members 48, 50 as shown. Bearings 102 and 104 are slideably adjustable by adjustment mechanisms 103 and 105. Lower axles 98 and 100 are axially aligned and rotationally mounted within bearings 103, 105 which are mounted on upright members 48, 50 near a lower end thereof. By mounting upper axle 96 on the backside of upright members 48, 50 and lower axles 98, 100 on the front side thereof, lower mechanism 26 is oriented at a smaller angle from horizontal than upper mechanism 24. Thus, lower mechanism 24 is better adapted for use by the operator's lower body, as discussed below. It is contemplated that lower axles 98 and 100 will be foreshortened to leave an open area between them to eliminate an area that may serve to bruise the operators ankles.

Endless chains 106 and 108 extend around sprockets 110, 112, 114 and 116 located on axles 96, 98 and 100, and can be tightened by movement of slideably adjustable bearings 102, 104 on upright members 48, 50. Sprockets 110, 112, 114, and 116 of lower mechanism 26 are larger than sprockets 76, 78, 80, and 82 of upper mechanism 24 to facilitate movement of platforms 118 around lower mechanism 26. Foot supports or platforms 118 extend horizontally between and attach to endless chains 106, 108 by use of brackets 90. An angle iron 122 extends between brackets 90 and attaches under platforms 118 to properly horizontally orient the upper surface 124 of platforms 118 during its useful segment of movement 123. Platforms 118 establish a path as they travel in an oblong pattern diagonally downwardly from upper axle 96, around aligned lower axles 98 and 100, upwardly toward upper axle 96, and around axle 96. It is contemplated that platforms 118 can be made of several different materials, but in the preferred embodiment will be made of a reinforced plastic material.

Figure 6:
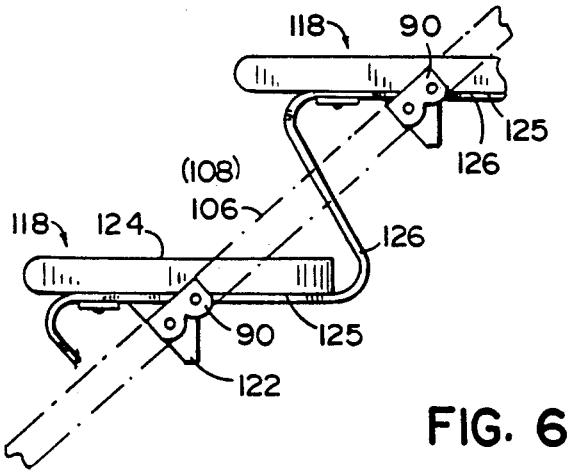
FIG. 6 is an enlarged side elevational view of the platforms and attachment thereof to the endless chains.

Flexible sheets 126 are attached to the bottom 125 of and between platforms 118 to form a barrier to the operators feet and legs to prevent them from entering the area between and behind platforms 118 during their movement through the useful segment 123 of their path (FIG. 6). Sheets 126 also improve aesthetics by closing off the area behind lower mechanism 24. Sheets 126 flexes and folds as needed as platforms 118 move around lower mechanism 24. During the diagonal downward movement of platforms 118, sheets 126 are stretched tightly enough to reduce the chance of objects being put into and between platforms, but loosely enough to prevent binding of endless chains 106, 108. It is contemplated that sheets 126 could be replaced with a hinged configuration such as is often used in escalators. Inner side shields 128 (FIG. 1) cover endless chains 106, 108 along the forward edge of upright members 48, 50 to protect against rubbing or contacting of chains 106, 108. These shields increase both safety and aesthetics.

Lower mechanism 26 is positioned at a smaller angle to horizontal than upper mechanism 24 so that lower mechanism 26 provides clearance for the knees of a user during the useful segment of travel by platforms 118 along their respective path. In the preferred embodiment, this angle is between about 45° and 60°, which is similar to the rise of steps in bleachers and the like. The angle of upper mechanism 22 to horizontal is between about 60 and 75°, which is similar to the angle of a ladder propped against a wall. It is contemplated that various angles can be used, and also that exerciser 20 can be made to allow adjustment of the angles as desired, by adjusting the angle of the base relative to the floor, or support surface, or by shimming any of the bearings inwardly or outwardly such as is shown by arrows A and B in FIG. 4.

A powering mechanism includes a motor 28 fastened to base 34. In the embodiment shown, motor 28 is a DC motor which drives a worm-gear speed reduction device 13 which rotates a drive sprocket 134. Motor 28 is a variable speed ⅛ HP DC motor operating at 1750 RPM. Speed reduction device 132 is a worm-gear reducer operating at 30:1 reduction rate, while sprockets 134, 138, 140 and other sprockets on upper and lower mechanisms 24, 26 are matched and sized to achieve the speed desired. A one-way friction clutch 133 attached to device 132 prevents the weight of a person on the exerciser from driving the platforms 118 and motor 28 at a speed faster than is desired. An endless primary drive chain 30 extends from sprocket 134 to sprocket 138 and drives axle 96. Motor 28 is adjustably positionable to tighten chain 30. In addition to driving lower mechanism 24, axle 96 supports a drive sprocket 140 and endless secondary drive chain 32 operably connected to drive axle 62. A tensioning device 144 attached to upright member 50 maintains the necessary tension on endless chain 32. Similar tensioning devices could be used on the other endless chains as may be required.

Figure 8:
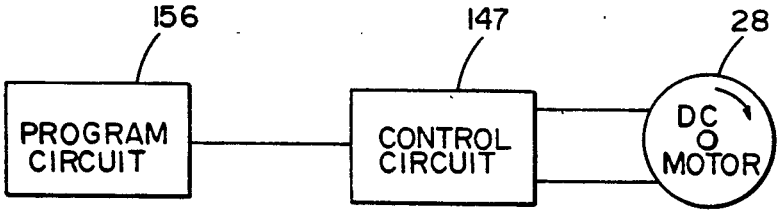
FIG. 8 is a schematic of the electrical circuit for the invention.

A control panel 146 is mounted to one side of upper mechanism 22 on brackets 148 at a convenient height for use by an operator positioned on exerciser 20. The control panel 146 shown, houses a control circuit 147 (FIG. 8) including an on/off switch 150, a variable speed control 152, and a timer 154. Speed control 152 is a rheostat which cooperates with DC motor 28 to controllably vary the speed of rungs 88 and platforms 118. Timer 154 allows a person using exerciser 20 to time their workout. It is contemplated that control panel 146 could include various readouts and mechanisms (not shown) such for measuring speed, pulse rate, calories burned, and the like. It is also contemplated that a programmable device 156 could be used to preset an exercise routine such as a warm-up speed for a few minutes, a faster intermediate speed for several minutes, and a warm-down speed.

Having described the components and parts of the preferred embodiment of the exerciser, its use and operation should be obvious to one skilled in the art. Briefly, exerciser 20 is positioned in a convenient location and is plugged into an electrical outlet. An operator desiring to use exerciser 20 first makes sure the unit is turned off, the variable speed is turned to a slow speed, and the rungs 88 and platforms 118 are not moving. The operator then steps onto a platform 118 and grasps a rung 88. The on/off switch 150 is flipped to the "on" position, and variable speed control 152 is rotated until rungs 88 and platforms 118 begin to move. The operator begins to grasp successive rungs 88 in a hand-over-hand motion as the rungs are presented in front of the operator, and simultaneously begins to step on successive platforms 118 also presented in below the operator. Since both the arms and legs of the operator are active, the operator's body is in "total suspension" such that the operator cannot become lazy or "cheat" by supporting part of their weight on a safety rail or other devices. At the same time, the operator is in control and need not fear falling since both the hands and feet can be actively used to stay in a balanced position. Further, since the operator's arms and legs are used, the exercise provided is a full body exercise which is aerobically balanced. If the operator desires a more vigorous pace, the speed of rungs 88 and platforms 118 are increased by use of variable speed control 152. Also, timer 154 indicates the length of time remaining in the workout.

If an operator should stumble or not keep up, shields 92, 94, 128 and flexible sheets 126 help reduce the risk of undesirable entanglement with rungs 88 and platforms 118. Additionally, shield 92 is designed with a blunted lower end 93 (FIG. 1) which tends to gently force an operator's wrist off of rungs 88 as rungs 88 move around axle 62 from the front to the rear, thus causing the operator to release their grasp of rungs 88 during this movement. Platforms 118 also tend to tip as they round lower axle 98, which deposits the operator onto the floor is the operator does not move to the next platform in time.

Figure 9:
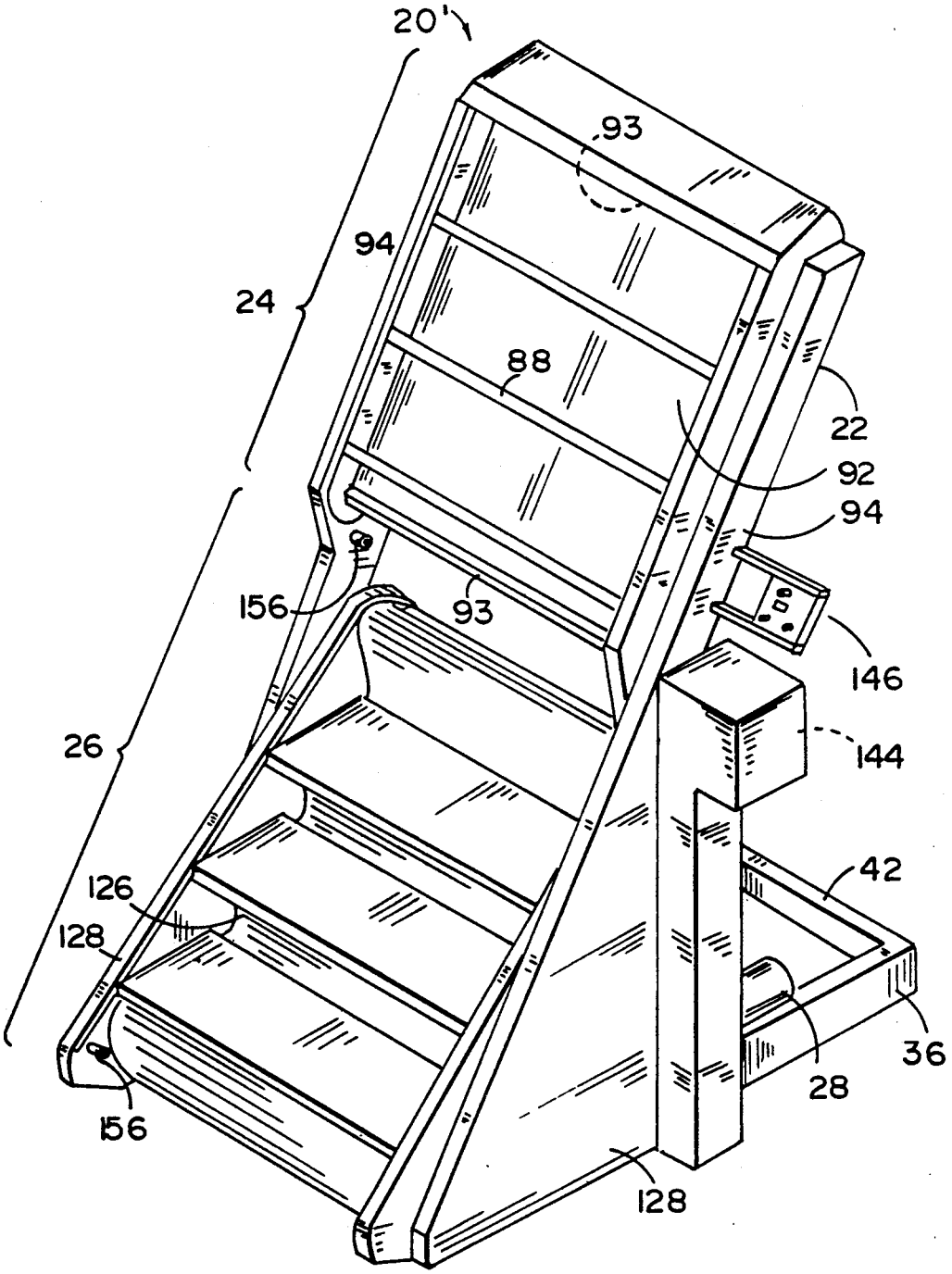
FIG. 9 is a perspective view of an alternative embodiment of the present invention.

In a first alternative embodiment, an exerciser 20' includes one or more photocells 156 (FIG. 9). Photocells 156 could be positioned at the lower end of upper or lower mechanisms 24, 26 to sense if the operator is falling behind and is therefore lower on exerciser 20 than is desired. Photocell 156 could be electrically connected to slow down or turn off the exerciser depending upon safety devices utilized or deemed necessary. It is contemplated that photocells 156 could also be placed in other positions.

Figure 10:
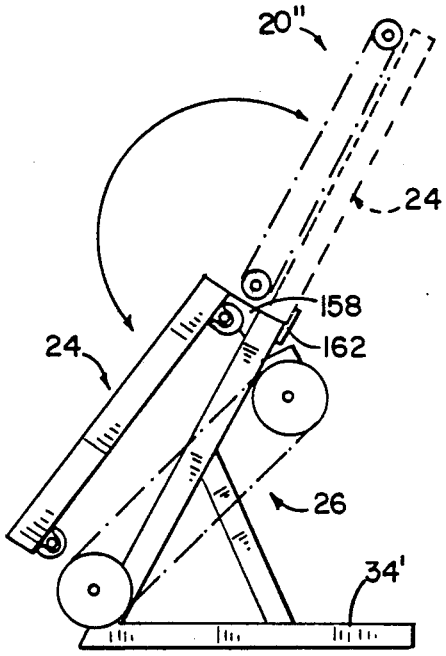
FIG. 10 is a side elevational view of yet another embodiment of the invention.

In a second alternative embodiment, an exerciser 20'' includes a pair of hinges 158 (FIG. 10) between upper 10 and lower portions of upright members 48, 50. Hinges 158 would be positioned on the front side of upright members 48, 50 so that upper mechanism 22 could be folded forwardly onto lower mechanism 24 in a compact arrangement for shipping. When ready for use, lower mechanism 24 would be tipped upwardly into position and locked rigidly in place by latches 162 on the backside of upright members 48, 50. Endless chain 32 would then be installed between drive sprocket 140 and axle 62 to ready exerciser 20 for use.

Changes and modifications in the specifically described embodiment can be carried out without departing from the principals of the invention, which is intended to be limited only by the scope of the appended claims, as interpreted according to the principals of patent law including the doctrine of equivalents.

The embodiments of the invention in which an exclusive property or privilege is claimed are defined as follows.

1. An exerciser comprising:

a first mechanism for exercising the upper body of an operator, said first mechanism including hand support means which move in a first path for, simulating a hand-over-hand motion;

a second mechanism rigidly connected to said first mechanism for exercising the lower body of the operator, said second mechanism including foot support means which move in a second path for simulating a stair-like climbing motion; and means for powering said first and second mechanisms.

2. The apparatus as defined by claim 1 wherein said second path is different than said first path.

3. The apparatus as defined by claim 2 wherein said second path is at a lower angle from horizontal than said first path.

4. The apparatus as defined by claim 1 wherein said means for powering includes a speed adjustment means for varying the speed of said hand support means and said foot support means.

5. The apparatus as defined by claim 4 including a friction clutch means for preventing the weight of an operator from increasing the speed of said means for powering beyond a predetermined rate.

6. The apparatus as defined by claim 4 including a programmable means for controllably presetting multiple speeds of said hand support means and said foot support means, and time durations for each speed.

7. The apparatus as defined by claim 5 wherein said hand support means includes rungs and wherein said foot support means includes platforms.

8. The apparatus as defined by claim 1 including a friction clutch means for preventing the weight of a person from increasing the speed of said first and second mechanisms beyond a predetermined rate.

9. The apparatus as defined by claim 1 including a programmable means for controllably presetting multiple speeds of said hand support means and said foot support means, and time durations for each speed.

10. The apparatus as defined by claim 1 wherein the angle of said first path from horizontal is between about 60° to 75°.

11. The apparatus as defined by claim 1 wherein the angle of said second path from horizontal is between about 45° to 60°.

12. The apparatus as defined by claim 1 wherein said foot support means includes multiple platforms.

13. The apparatus as defined by claim 12 wherein said second mechanism includes a pair of endless chains attached to the ends of each of said multiple platforms, and further includes a pair of axle means defining an upper and lower axis of rotation for movably carrying said endless chains, the lower of said axle means including a split shaft.

14. The apparatus as defined by claim 1 including a sheet of flexible material fastened to each of said foot support means so that said flexible material drapingly extends between successive parts of said foot support means.

15. The apparatus as defined by claim 1 wherein said hand support means includes multiple rungs and wherein said foot support means includes multiple platforms.

16. The apparatus as defined by claim 15 wherein said first mechanism includes a first pair of endless chains attached to the ends of each of said rungs for carrying said rungs along said first path and wherein said second mechanism includes a second pair of endless chains attached to the ends of each of said platforms for carrying said platforms along said second path.

17. The apparatus as defined by claim 1 including a photocell positioned to shine a beam across a lower portion of one of said paths and including means for detecting interruption of said beam, said photocell operably connected to stop said first and second mechanisms.

18. The apparatus as defined by claim 1 wherein said first and second mechanisms are pivotally interconnected between a folded position for shipping and an upright position for use.

19. An exerciser comprising:

a first portion for exercising the upper body of an operator including hand support members which move in a first path at a first angle from horizontal for simulating a hand-over-hand motion;

a second portion rigidly connected to said first portion for exercising the lower body of ) an operator including foot support members which move in a second path at a second angle from horizontal for simulating stair-like climbing motion, said second angle being different than said first angle; and means for powering said first and second mechanisms.

20. The apparatus as defined by claim 19 wherein said first angle is between about 60° and 75°.

21. The apparatus as defined by claim 20 wherein said said second angle is between about 45° and 60°.

22. The apparatus as defined by claim 21 wherein said first angle is between about 60° and 75°.

23. The apparatus as defined by claim 20 wherein the speed of said means for powering is variable.

24. The apparatus as defined by claim 19 including a friction clutch means for preventing the weight of an operator from increasing the speed of said hand and foot support members beyond a predetermined rate.

25. An apparatus for exercising the upper and lower body of an operator, comprising:

a frame;

an upper pair of axle means horizontally oriented and mounted to said frame for rotational movement;

an upper mechanism for exercising the upper body of an operator, said upper mechanism operably connected between said upper pair of axle means;

a plurality of hand supports mounted on said upper mechanism and moveable along an upper path defined by said upper mechanism;

a lower pair of axle means horizontally oriented and mounted to said frame for rotational movement thereon;

a lower mechanism for exercising the lower body of an operator, said lower mechanism operably connected between said lower pair of axle means; and a plurality of platforms mounted on said lower mechanism and moveable along a lower path defined by said lower mechanism.

26. The apparatus as defined by claim 25 including means for powering said upper and lower mechanisms.

27. The apparatus as defined by claim 25 wherein said lower mechanism provides clearance for the knees of the operator during use.

28. The apparatus as defined by claim 25 wherein said upper and lower paths are oriented at different angles from horizontal.

29. The apparatus as defined by claim 25 wherein said lower path defines a lower angle from horizontal than said upper path.

30. The apparatus as defined by claim 25 further including a sheet of flexible material fastened between said plurality of platforms.

31. The apparatus as defined by claim 25 wherein said upper and lower mechanisms are pivotally interconnected between a folded position for shipping and an upright position for use.

32. The apparatus as defined by claim 25 further including a photocell positioned to shine a beam across and below one of said paths and including means for detecting interruption of said beam, said photocell operably connected to stop said first and second mechanisms.

* * * * *

UNITED STATES PATENT AND TRADEMARK OFFICE

CERTIFICATE OF CORRECTION

PATENT NO. : 5,145,475

DATED : September 8, 1992

INVENTOR(S) : Paul Cares

It is certified that error appears in the above-identified patent and that said Letters Patent is hereby corrected as shown below:

Column 7, line 42, claim 19;
After "body of" delete --)--.

Column 7, line 51, claim 21;
"claim 20" should be --claim 19--.

Column 8, line 3, claim 23;
"claim 20" should be --claim 19--.

Signed and Sealed this

Sixteenth Day of November, 1993

Bruce Lehman

*Attest:*

BRUCE LEHMAN

*Attesting Officer*

*Commissioner of Patents and Trademarks*